US008395549B2

(12) United States Patent
Liu

(10) Patent No.: US 8,395,549 B2
(45) Date of Patent: Mar. 12, 2013

(54) TRIPLE BAND ANTENNA

(75) Inventor: Ming-Yen Liu, Taipei (TW)

(73) Assignee: ASUSTek Computer Inc., Taipei (TW)

( * ) Notice: Subject to any disclaimer, the term of this patent is extended or adjusted under 35 U.S.C. 154(b) by 330 days.

(21) Appl. No.: 12/212,056

(22) Filed: Sep. 17, 2008

(65) Prior Publication Data

US 2009/0184876 A1 Jul. 23, 2009

(30) Foreign Application Priority Data

Jan. 22, 2008 (TW) ..... 97102350 A

(51) Int. Cl.
*H01Q 1/38* (2006.01)

(52) U.S. Cl. ..... 343/700 MS; 343/846

(58) Field of Classification Search ..... 343/700, 343/702, 846
See application file for complete search history.

(56) References Cited

U.S. PATENT DOCUMENTS

| | | | | |
|---|---|---|---|---|
| 7,528,791 | B2 * | 5/2009 | Tsai et al. | 343/846 |
| 2004/0017315 | A1 | 1/2004 | Fang et al. | |
| 2007/0229358 | A1 * | 10/2007 | Chi et al. | 343/700 MS |
| 2007/0229366 | A1 | 10/2007 | Kim et al. | |

FOREIGN PATENT DOCUMENTS

| | | |
|---|---|---|
| CN | 1474478 A | 2/2004 |
| TW | 557608 | 10/2003 |
| TW | 200644339 | 12/2006 |
| TW | 200743266 | 11/2007 |
| TW | 200803052 | 1/2008 |

OTHER PUBLICATIONS

Liu W-C. "Wideband dual-frequency double inverted-L CPW-fed monopole antenna for WLAN application", Microwaves, Antannas and Propagation, vol. 152, No. 6, Dec. 9, 2005, pp. 505-510, IEEE , US.

Tilley K et al. "Dual frequency coplanar strip dipole antenna", Jun. 1994, pp. 928-931, IEEE, US.

W.-C. Liu. "Wideband Dual-Frequency Double Inverted-L CPW-Fed monopole Antenna for WLAN Application," Microwaves, Antennas and Propagation, Dec. 6, 2005, p. 505-510, vol. 152, No. 6, IEEE, US.

W.-C. Liu et al., "Compact Triple-Band Slotted Monopole Antenna with Asymmetrical CPW Grounds," Electronics Letters, Jul. 20, 2006, p. 840-842, vol. 42, No. 15, IEEE, US.

* cited by examiner

*Primary Examiner* — Hoang V Nguyen
*Assistant Examiner* — Kyana R Robinson

(57) ABSTRACT

A triple band antenna includes a feed-in portion, a first radiating portion, a second radiating portion, a third radiating portion and a grounding portion. The first radiating portion is connected to a first side of a first end of the feed-in portion. A second end of the second radiating portion is connected to a second side of the first end of the feed-in portion. The third radiating portion is connected to a third end of the second radiating portion. The grounding portion is located at two sides of the feed-in portion.

19 Claims, 7 Drawing Sheets

TRIPLE BAND ANTENNA

CROSS REFERENCE TO RELATED APPLICATIONS

This application claims priority of Taiwan Patent Application No. 97102350, filed on Jan. 22, 2008, the entirety of which is incorporated by reference herein.

BACKGROUND OF THE INVENTION

1. Field of the Invention

The invention relates to an antenna and, more particularly, to a triple band antenna.

2. Description of the Related Art

In recent years, wireless communication standards are closely integrated into mobile devices. For example, a mobile phone, a hand-held game, a MP3, a MP4, a PMP, a mobile TV, a GPS and a peripheral control device are integrated with a plurality of wireless standards such as the Wi-Fi standard, and they greatly need embedded antennas, and therefore, miniature antennas are essential components for embedded mobile applications.

The design tendency is to be thin besides miniature. As for a 3C products on the market, such as a mobile phone, a common portable intelligent device and a consumer electronic product, fashionable, thin and light factors are gradually taken into account when consumers buy products, and therefore, antennas for mobile applications are intended to be designed to be miniature, thin and embedded even intelligent and multi-band in the future.

The so-called miniature antenna is a microstrip antenna for meeting with the new tendency caused by the application requirement of portable and hand-held devices. Generally speaking, the miniature antennas mostly are planar antennas or array planar antennas with a plurality of plates, and they also may be designed in other mode such as a slot design mode.

Generally speaking, the antennas used in miniature structures include a planar inverted F antenna (PIFA), a unipole antenna and a dipole antenna. For example, as for a mobile phone, the miniature antenna structure commonly used in the mobile phone is a dipole antenna. Although the miniature antenna structure is a type of dipole antenna, the shape of the miniature antenna structure is greatly changed to reduce the volume of the miniature antenna structure. The miniature antenna structure may be circular, elliptic, rectangular or trigonal to allow the antenna unit to be further slim, light, small and short.

Additional miniature antenna structures that are not integrated with application circuits include a patch antenna, a surface mountable antenna and a helical antenna. The embedded mode often utilizes the PIFA in recent years, and this type of antenna has a short circuit structure for reducing the resonance length of the antenna from a half to a quarter, and then the antenna is further smaller.

FIG. 1 is a schematic diagram showing a conventional dual-band antenna. A dual-band antenna 10 includes a feed-in portion 101, a high-frequency radiating portion 102, a low-frequency radiating portion 103 and a grounding portion 104. The high-frequency radiating portion 102 extends from the feed-in portion 101, the low-frequency radiating portion 103 extends from the feed-in portion 101, and the grounding portion 104 is connected to the low-frequency radiating portion 103 and the high-frequency radiating portion 102.

The dual-band antenna is inadequate due to the development of the WIMAX technology, which reflects the importance of the triple band antenna. Therefore, a triple band with a broad operating bandwidth, a small volume and a simple structure is an important development objective of the antenna technology in the future.

BRIEF SUMMARY OF THE INVENTION

The invention provides a triple band antenna. The triple band antenna has a plurality slits, and the first radiating portion, the second radiating portion or the third radiating portion of the triple band antenna is designed to gradually change to facilitate the impedance matching and increase the operating bandwidth.

The invention provides a triple band antenna including a feed-in portion, a first radiating portion, a second radiating portion, a third radiating portion and a grounding portion. The first radiating portion is connected to a first side of a first end of the feed-in portion. A second end of the second radiating portion is connected to a second side of the first end of the feed-in portion. The third radiating portion is connected to a third end of the second radiating portion. The grounding portion is located at two sides of the feed-in portion.

The first radiating portion is a middle-frequency radiating portion.

The second radiating portion is a high-frequency radiating portion.

The third radiating portion is a low-frequency radiating portion.

The triple band antenna further includes a first slit disposed between the grounding portion and the feed-in portion.

The triple band antenna further includes a matching slot communicating with the first slit and the matching slot located between the first slit and the grounding portion.

The triple band antenna further includes a second slit disposed between the grounding portion and the second radiating portion.

The triple band antenna further includes a third slit disposed between the grounding portion and the third radiating portion and the third slit communicating with the second slit.

The first radiating portion extends from the first side of the first end of the feed-in portion and the first radiating portion gradually broadens.

The second radiating portion extends from the second side of the first end of the feed-in portion and the second radiating portion gradually broadens.

The third radiating portion extends from the third end of the second radiating portion and the third radiating portion gradually broadens.

The feed-in portion, the first radiating portion, the second radiating portion, the third radiating portion and the grounding portion are coplanar.

To sum up, the invention provides the triple band antenna. The triple band antenna has a plurality slits, and the first radiating portion, the second radiating portion or the third radiating portion of the triple band antenna is designed to gradually change to facilitate the impedance matching and increase the operating band.

These and other features, aspects, and advantages of the present invention will become better understood with regard to the following description, appended claims, and accompanying drawings.

DETAILED DESCRIPTION OF THE EMBODIMENTS

Figure 1:
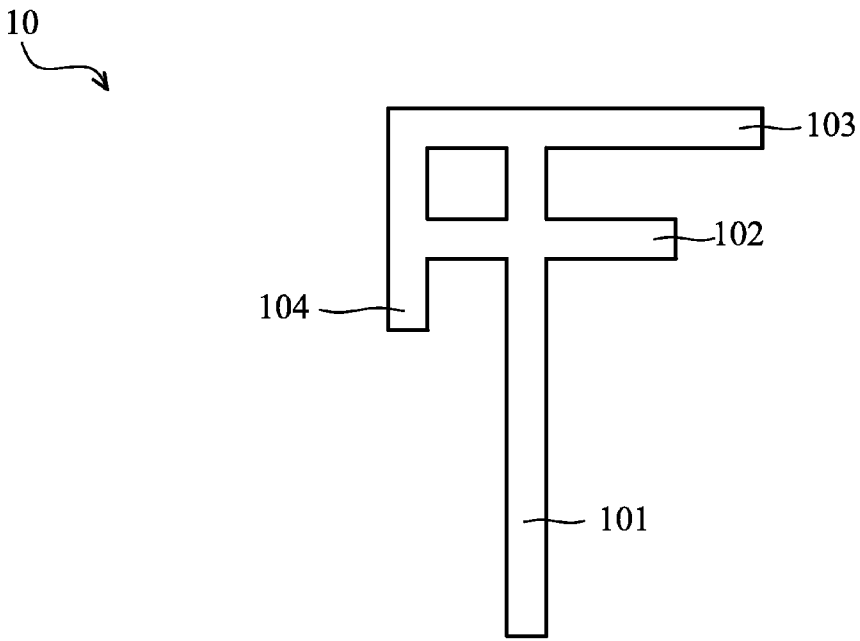
FIG. 1 ( PRIOR ART )
FIG. 1 is a schematic diagram showing a conventional dual-band antenna.
Figure 2A:
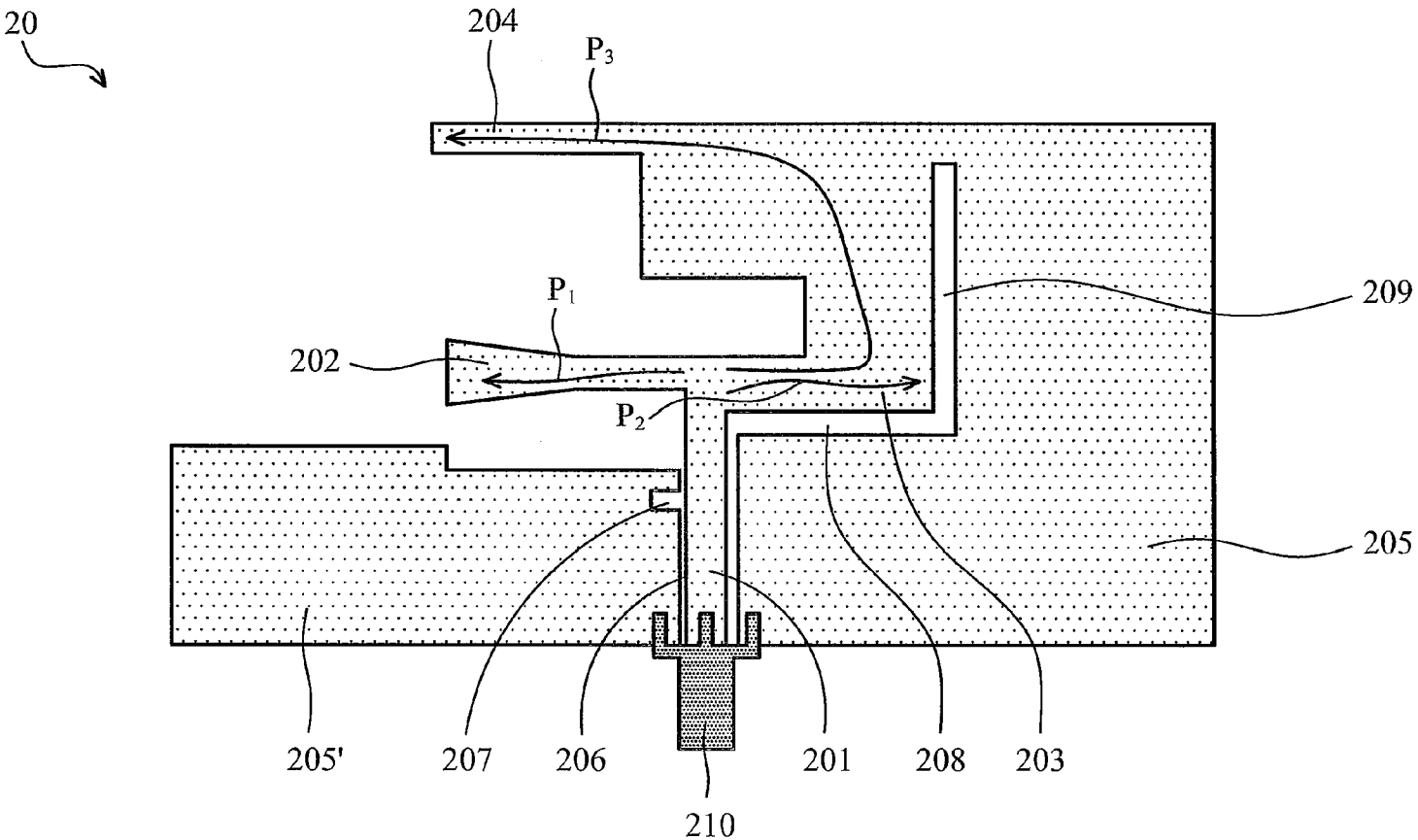
FIG. 2A is a schematic diagram showing a triple-band antenna according to the first embodiment of the invention.
Figure 2B:
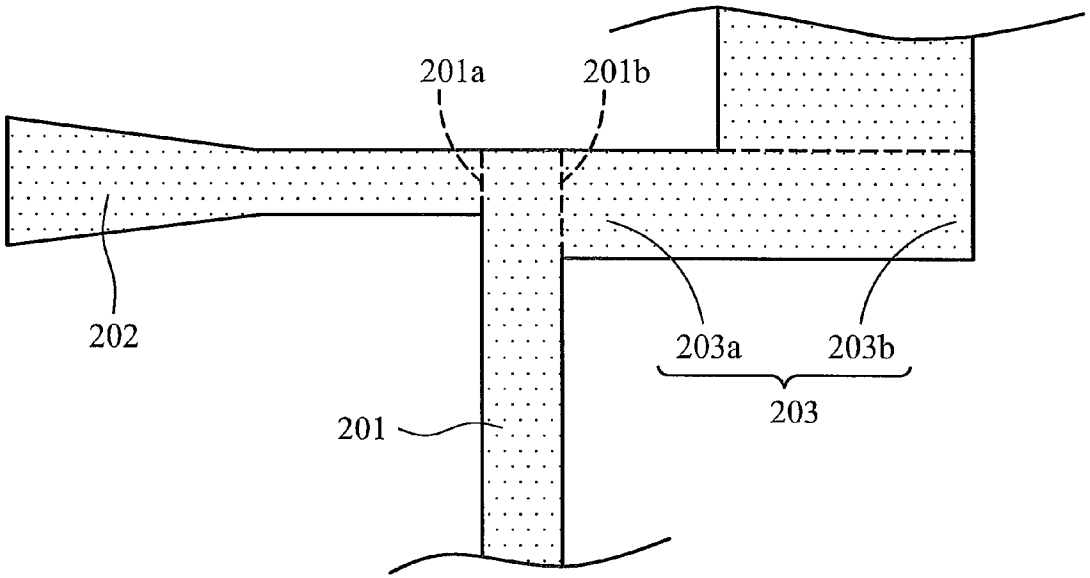
FIG. 2B is a partial enlarged drawing of the first embodiment of the invention.

FIG. 2A is a schematic diagram showing a triple-band antenna according to the first embodiment of the invention, and FIG. 2B is a partial enlarged drawing of the first embodiment of the invention. As shown in FIG. 2A and FIG. 2B, a triple band antenna 20 includes a feed-in portion 201, a first radiating portion 202, a second radiating portion 203, a third radiating portion 204, two grounding portion 205, 205', a first slit 206, a second slit 208 and a third slit 209. The triple band antenna 20 is a coplanar antenna, and its components are described as follows.

The first radiating portion 202 is connected to a first side 201*a* of a first end of the feed-in portion 201. A second end 203*a* of the second radiating portion 203 is connected to a second side 201*b* of the first end of the feed-in portion 201. The third radiating portion 204 is connected to a third end 203*b* of the second radiating portion 203. Therefore, the third radiating portion 204 and the second radiating portion 203 have an overlapped area for two signals of different bands to use, and the two signals may be a high-frequency signal and a low-frequency signal. The first radiating portion 202 gradually broadens toward its end, and the design of gradually changing the width of the first radiating portion 202 allows the operating bandwidth of the first radiating portion 202 to increase.

The grounding portion 205 and 205' are located at two sides of the feed-in portion 201, respectively, and the grounding portion 205 and 205' and the feed-in portion 201 are connected to a circuit board (not shown) via a connector 210.

The first slit 206 is disposed between the grounding portion 205' and the feed-in portion 201. A matching slot 207 may be designed to communicate with the first slit 206 and is located between the first slit 206 and the grounding portion 205'. The first slit 206 and the matching slot 207 are designed to communicate with each other to facilitate the impedance matching of the feed-in portion 201 and increase the operating bandwidth.

The second slit 208 is disposed between the grounding portion 205 and the second radiating portion 203, and the third slit 209 is disposed between the grounding portion 205 and the third radiating portion 204 and communicates with the second slit 208. The second slit 208 and the third slit 209 are designed to communicate with each other to increase the operating band of the second radiating portion 203 and facilitate the impedance matching of the second radiating portion 203.

In FIG. 2A, $P_1$, $P_2$ and $P_3$ represent flow paths of signals in the first radiating portion 202, the second radiating portion 203 and the third radiating portion 204, respectively. The first radiating portion 202 may be a middle-frequency radiating portion, the second radiating portion 203 may be a high-frequency radiating portion, and the third radiating portion 204 may be a low-frequency radiating portion. The first radiating portion 202 may be the middle-frequency radiating portion whose operating band is between 3.3G and 3.8G. The second radiating portion 203 may be the high-frequency radiating portion whose operating band is between 5G and 6G. The third radiating portion 204 may be the low-frequency radiating portion whose operating band is between 2.4G and 2.5G.

Figure 3A:
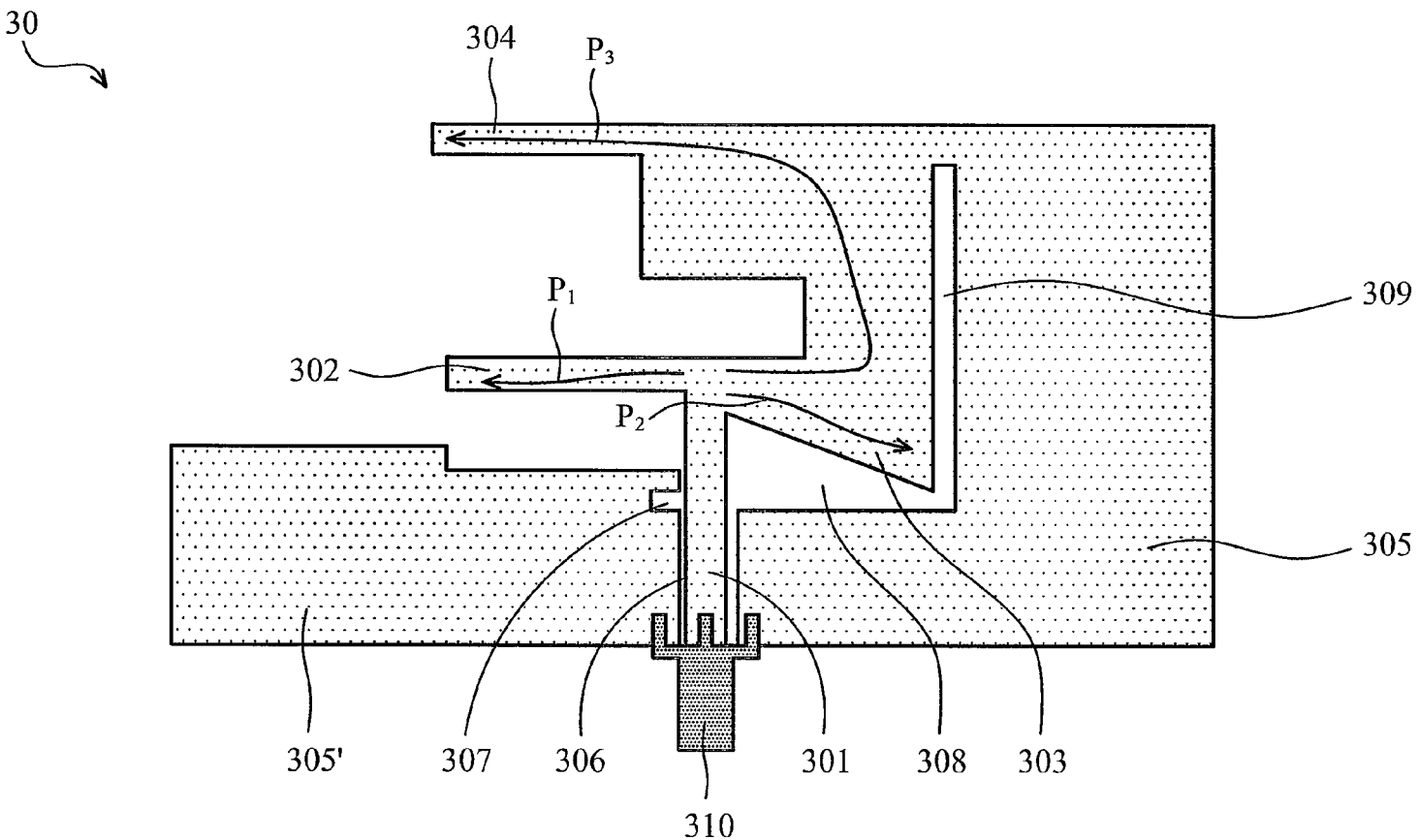
FIG. 3A is a schematic diagram showing a triple-band antenna according to the second embodiment of the invention.
Figure 3B:
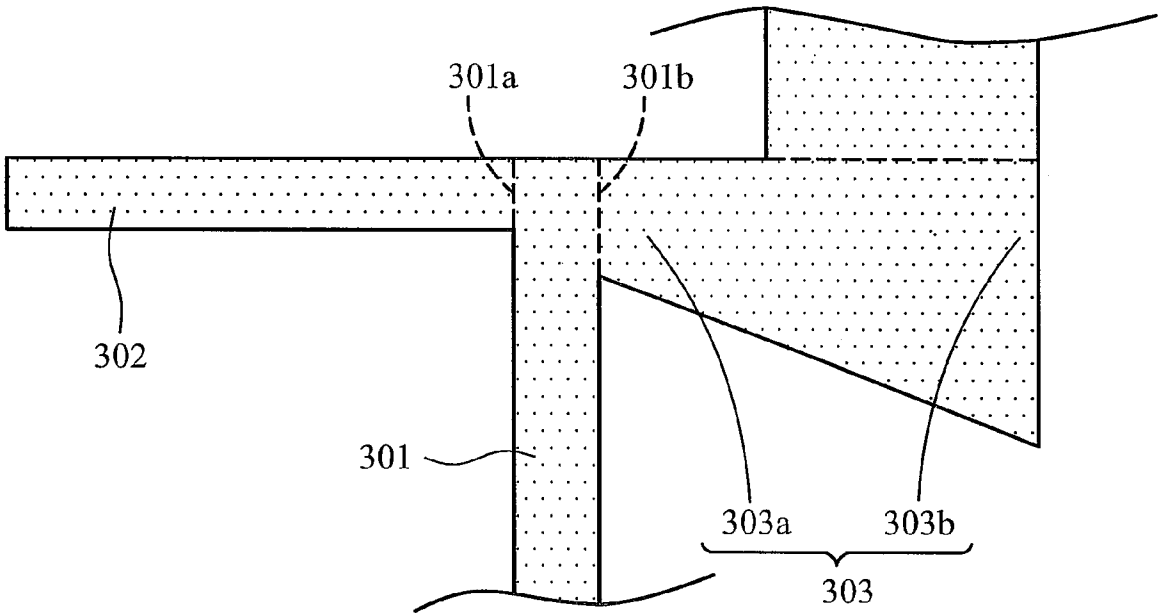
FIG. 3B a partial enlarged drawing of the second embodiment of the invention.

FIG. 3A is a schematic diagram showing a triple band antenna according to the second embodiment of the invention, and FIG. 3B is a partial enlarged drawing of the second embodiment of the invention. As shown in FIG. 3A and FIG. 3B, a triple band antenna 30 includes a feed-in portion 301, a first radiating portion 302, a second radiating portion 303, a third radiating portion 304, two grounding portion 305, 305', a first slit 306, a second slit 308 and a third slit 309. The triple band antenna 30 is a coplanar antenna, and its components are described as follows.

The first radiating portion 302 is connected to a first side 301*a* of a first end of the feed-in portion 301. A second end 303*a* of the second radiating portion 303 is connected to a second side 301*b* of the first end of the feed-in portion 301. The third radiating portion 304 is connected to a third end 303*b* of the second radiating portion 303. Therefore, the third radiating portion 304 and the second radiating portion 303 have an overlapped area. The second radiating portion 303 gradually broadens toward its end, and the design of gradually changing the width of the second radiating portion 303 allows the operating bandwidth of the second radiating portion 303 to increase.

The grounding portion 305 and 305' are located at two sides of the feed-in portion 301, respectively, and the grounding portion 305 and 305' and the feed-in portion 301 are connected to a circuit board (not shown) via a connector 310.

The first slit 306 is disposed between the grounding portion 305' and the feed-in portion 301. A matching slot 307 may be designed to communicate with the first slit 306 and is located between the first slit 306 and the grounding portion 305'. The first slit 306 and the matching slot 307 are designed to communicate with each other to facilitate the impedance matching of the feed-in portion 301.

The second slit 308 is disposed between the grounding portion 305 and the second radiating portion 303, and the third slit 309 is disposed between the grounding portion 305 and the third radiating portion 304 and communicates with the second slit 308. The second slit 308 and the third slit 309 are designed to communicate with each other to increase the operating bandwidth of the second radiating portion 303 and facilitate the impedance matching of the second radiating portion 303.

In FIG. 3A, $P_1'$, $P_2'$ and $P_3'$ represent flow paths of signals in the first radiating portion 302, the second radiating portion 303 and the third radiating portion 304, respectively. The first radiating portion 302 may be a middle-frequency radiating portion, the second radiating portion 303 may be a high-frequency radiating portion, and the third radiating portion 304 may be a low-frequency radiating portion.

Figure 4A:
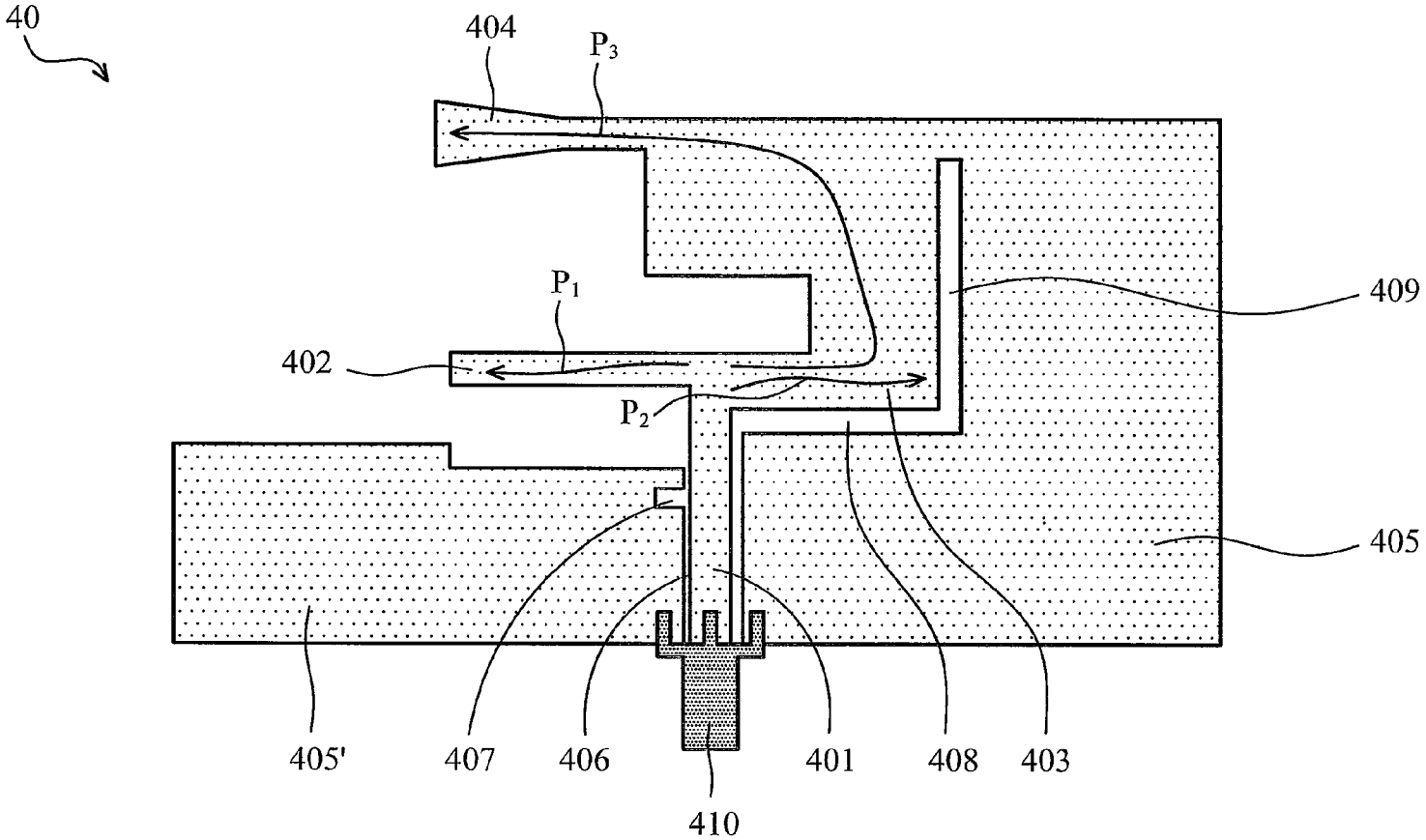
FIG. 4A is a schematic diagram showing a triple-band antenna according to the third embodiment of the invention.
Figure 4B:
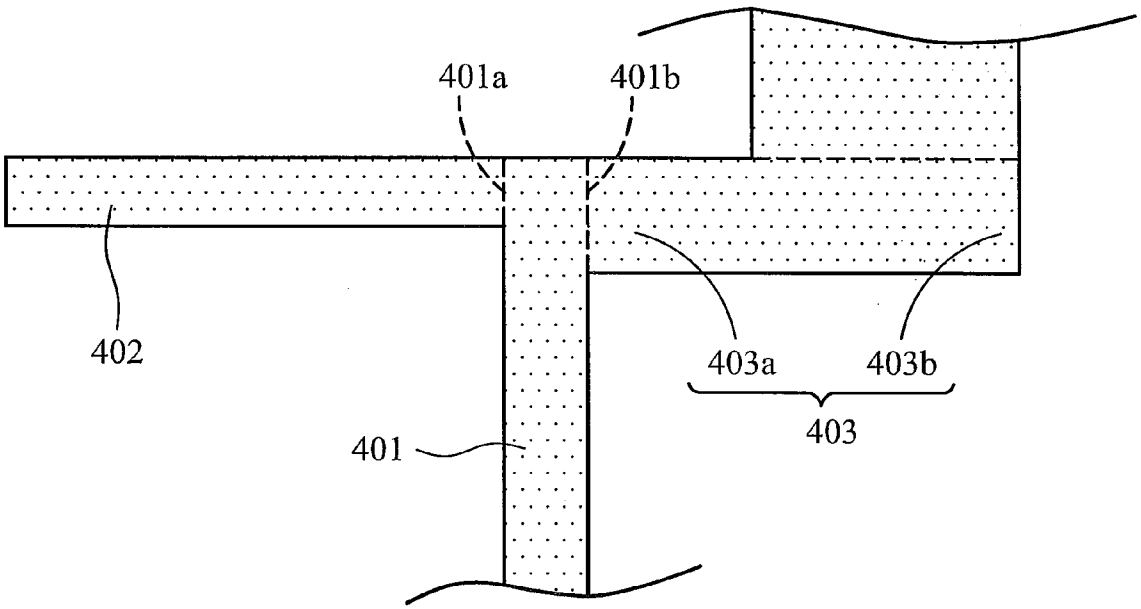
FIG. 4B a partial enlarged drawing of the third embodiment of the invention.

FIG. 4A is a schematic diagram showing a triple band antenna according to the third embodiment of the invention, and FIG. 4B is a partial enlarged drawing of the third embodiment of the invention. As shown in FIG. 4A and FIG. 4B, a triple band antenna 40 includes a feed-in portion 401, a first radiating portion 402, a second radiating portion 403, a third radiating portion 404, two grounding portion 405, 405', a first slit 406, a second slit 408 and a third slit 409. The triple band antenna 40 is a coplanar antenna, and its components are described as follows.

The first radiating portion 402 is connected to a first side 401*a* of a first end of the feed-in portion 401. A second end 403*a* of the second radiating portion 403 is connected to a second side 401*b* of the first end of the feed-in portion 401. The third radiating portion 404 is connected to a third end 403*b* of the second radiating portion 403. Therefore, the third radiating portion 404 and the second radiating portion 403 have an overlapped area. The third radiating portion 404 gradually broadens toward its end, and the design of gradually changing the width of the third radiating portion 404 allows the operating bandwidth of the third radiating portion 404 to increase.

The grounding portion 405 and 405' are located at two sides of the feed-in portion 401, respectively, and the grounding portion 405 and 405' and the feed-in portion 401 are connected to a circuit board (not shown) via a connector 410.

The first slit 406 is disposed between the grounding portion 405' and the feed-in portion 301. A matching slot 407 may be designed to communicate with the first slit 306 and is located between the first slit 406 and the grounding portion 405'. The first slit 406 and the matching slot 407 are designed to communicate with each other to facilitate the impedance matching of the feed-in portion 401.

The second slit 408 is disposed between the grounding portion 405 and the second radiating portion 403, and the third slit 409 is disposed between the grounding portion 405 and the third radiating portion 404 and communicates with the second slit 408. The second slit 408 and the third slit 409 are designed to communicate with each other to increase the operating bandwidth of the second radiating portion 403 and facilitate the impedance matching of the second radiating portion 403.

In FIG. 4A, $P_1''$, $P_2''$ and $P_3''$ represent flow paths of signals in the first radiating portion 402, the second radiating portion 403 and the third radiating portion 404, respectively. The first radiating portion 402 may be a middle-frequency radiating portion, the second radiating portion 403 may be a high-frequency radiating portion, and the third radiating portion 404 may be a low-frequency radiating portion.

Although the present invention has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

What is claimed is:

1. A triple band antenna comprising:

a feed-in portion;

a first radiating portion directly connected to a first side of a first end of the feed-in portion;

a second radiating portion, a second end of the second radiating portion is connected to a second side of the first end of the feed-in portion;

a third radiating portion connected to a third end of the second radiating portion;

a grounding portion located at two sides of the feed-in portion;

a second slit disposed between the grounding portion and the second radiating portion; and a third slit disposed extending from the second slit and arranged directly between the grounding portion and the third radiating portion, wherein the third slit is directly communicating with the second slit.

2. The triple band antenna according to claim 1, wherein the first radiating portion is a middle-frequency radiating portion.

3. The triple band antenna according to claim 1, wherein the second radiating portion is a high-frequency radiating portion.

4. The triple band antenna according to claim 1, wherein the third radiating portion is a low-frequency radiating portion.

5. The triple band antenna according to claim 1 further comprising a first slit disposed between the grounding portion and the feed-in portion.

6. The triple band antenna according to claim 5 further comprising a matching slot communicating with the first slit and the matching slot located between the first slit and the grounding portion.

7. The triple band antenna according to claim 1, wherein the first radiating portion extends from the first side of the first end of the feed-in portion and the first radiating portion gradually broadens.

8. The triple band antenna according to claim 1, wherein the second radiating portion extends from the second side of the first end of the feed-in portion and the second radiating portion gradually broadens.

9. The triple band antenna according to claim 1, wherein the third radiating portion extends from the third end of the second radiating portion and the third radiating portion gradually broadens.

10. The triple band antenna according to claim 1, wherein the feed-in portion, the first radiating portion, the second radiating portion, the third radiating portion and the grounding portion are coplanar.

11. The triple band antenna according to claim 1, wherein the grounding portion comprises a first part and a second part, the first part separated from the second part by the feeding portion and a first slit located at two sides of the feed-in portion.

12. A triple band antenna comprising:

a feed-in portion;

a grounding portion comprising a first part and a second part, the first part separated from the second part by the feeding portion and a first slit located at two sides of the feed-in portion;

a connector, wherein the feed-in portion, the first part of the grounding portion, and the second part of the grounding portion are connected via the connector;

a first radiating portion connected to a first side of a first end of the feed-in portion;

a second radiating portion, a second end of the second radiating portion is connected to a second side of the first end of the feed-in portion;

a third radiating portion connected to a third end of the second radiating portion;

a second slit disposed between the grounding portion and the second radiating portion; and a third slit disposed extending from the second slit and arranged directly between the grounding portion and the third radiating portion, wherein the third slit is directly communicating with the second slit, wherein the second radiating portion extends from the second side of the first end of the feed-in portion and the second radiating portion gradually broadens.

13. The triple band antenna according to claim 12, wherein the first radiating portion is a middle-frequency radiating portion.

14. The triple band antenna according to claim 12, wherein the second radiating portion is a high-frequency radiating portion.

15. The triple band antenna according to claim 12, wherein the third radiating portion is a low-frequency radiating portion.

16. The triple band antenna according to claim 12 further comprising a matching slot communicating with the first slit and the matching slot located between the first slit and the grounding portion.

17. The triple band antenna according to claim 12, wherein the first radiating portion extends from the first side of the first end of the feed-in portion and the first radiating portion gradually broadens.

18. The triple band antenna according to claim 12, wherein the third radiating portion extends from the third end of the second radiating portion and the third radiating portion gradually broadens.

19. The triple band antenna according to claim 12, wherein the feed-in portion, the first radiating portion, the second radiating portion, the third radiating portion, the first part of the grounding portion, the second part of the grounding portion, the first slit, the second slit and the third slit are coplanar.

* * * * *